United States Patent [19]

Koide et al.

[11] Patent Number: 4,479,725

[45] Date of Patent: Oct. 30, 1984

[54] WATCHCASE

[75] Inventors: Hiroshi Koide, Tanashi; Toshiaki Sawada, Kitakami, both of Japan

[73] Assignee: Citizen Watch Co., Ltd., Tokyo, Japan

[21] Appl. No.: 483,379

[22] Filed: Apr. 8, 1983

[30] Foreign Application Priority Data

Apr. 20, 1982 [JP] Japan ..... 57-57467[U]

[51] Int. Cl.[3] ..... G04B 37/00

[52] U.S. Cl. ..... 368/292; 368/280; 368/309

[58] Field of Search ..... 368/291, 292, 280, 309

[56] References Cited

U.S. PATENT DOCUMENTS 3,817,025 6/1974 Siegrist ..... 368/291

4,363,555 12/1982 Finger ..... 368/291

4,397,566 8/1983 Lederrey ..... 368/291

*Primary Examiner*—Bernard Roskoski

*Attorney, Agent, or Firm*—Birch, Stewart, Kolasch & Birch

[57] ABSTRACT

A watchcase comprising a case body having a recessed shoulder at the corner of the axially extending inside wall and the bottom thereof, and a back made of hard metal having a longitudinal elasticity modulus larger than 25,000 kg/mm$^2$ and secured to the bottom of the case body. A reinforcement ring having an L-shaped section is secured to the inside wall of the back so that a groove is defined by the outside wall of the reinforcement ring and the inside wall of the recessed shoulder. An O-ring is engaged with the groove for water-tight sealing.

3 Claims, 2 Drawing Figures

WATCHCASE

BACKGROUND OF THE INVENTION

The present invention relates to an improvement of a back of a water-resisting watchcase.

In recent years, there has been a demand for thinner watches. FIG. 1 shows an example of such thin water-resisting watches. A case body 1 has a square shape front and comprises a radially extending upper portion and an axially extending side wall portion. An annular recess 1*a* is provided in a bottom of the side wall portion for engaging an O-ring 2. A back 3 is secured to the case body 1 by a plurality of screws 4. A glass 5 is engaged with the radially extending upper portion of the case body 1 interposing a packing 6. A module 7 is disposed in the watchcase.

In this watchcase, the back 3 is made of stainless steel having longitudinal elasticity modulus of 18,000 kg/mm$^2$. Explaining the deflection of the back having a rectangular shape, for example rectangle of 27.5 mm×23.5 mm, and having thickness a of 0.6 mm, if the watchcase is subjected to four atmosperic pressure, the back 3 is deflected 0.53–0.57 mm at a central portion thereof. In order to allow such a deflection, it is necessary to leave a space b between the back 3 and module 7 about 0.60 mm. Accordingly, if thickness c of the glass 5 is 0.6 mm, space d between the glass 5 and module 7 is 0.55 mm, and thickness e of the module 7 is 1.2 mm, the whole thickness t of the watchcase, that is, $t=a+b+c+d+e$, is 3.55 mm. Since a minimum thickness a of the back 3 and the minimum space b between the back 3 and module 7 are 0.6 mm respectively, it is difficult to decrease the thickness t less than 3.55 mm.

SUMMARY OF THE INVENTION

An object of the present invention is to provide a watchcase structure which may be extremely decreased in thickness.

According to the present invention, there is provided a watchcase comprising a case body having a recessed shoulder at the corner of the axially extending inside wall and the bottom thereof, a back made of hard metal having a longitudinal elasticity modulus larger than 25,000 kg/mm$^2$, means for securing said back to the bottom of said case body, a reinforcement member having an outside wall and secured to the inside wall of said back so that a groove is defined by the outside wall of said reinforcement member and the inside wall of said recessed shoulder, and an O-ring engaged with said groove.

In accordance with the present invention, the back 3 is made of hard metal such as Co-alloy, W-alloy or Mo-alloy which has more than 25,000 kg/mm$^2$ in modulus of longitudinal elasticity. Under the same construction as before mentioned FIG. 1, if thickness a of the back is 0.6 mm, the back 3 is deflected by a small value between 0.12 and 0.19 mm. Therefore, the space b between the back 3 and module 7 can be reduced to about 0.2 mm, which means reduction of 0.4 mm in space b compared with that of the conventional watchcase. Therefore, the whole thickness t of the watchcase becomes 3.15 mm. However, the replacement of material of the back 3 is not sufficient to provide a much thinner watchcase.

Other objects and features of the present invention will become more apparent from the following description with reference to the accompanying drawings.

DESCRIPTION OF THE PREFERRED EMBODIMENTS

Figure 1:
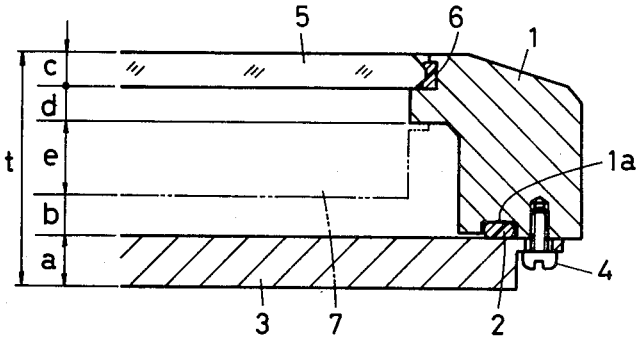
FIG. 1 is a sectional view of a conventional watchcase.
Figure 2:
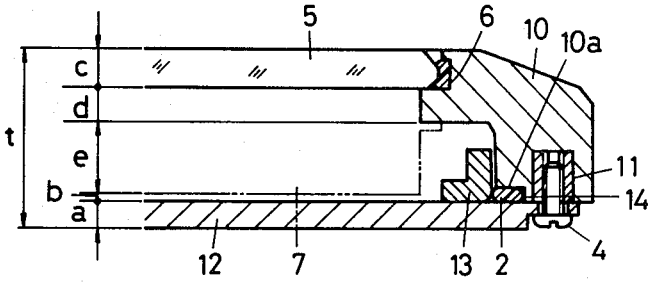
PRIOR ART FIG. 2
FIG. 2 is a sectional view of a watchcase according to the present invention.

FIG. 2 shows a water-resisting watchcase according to the present invention. The same parts as the above mentioned watchcare identified with the same reference numerals as FIG. 1. A side wall of a case body 10 has a recessed shoulder 10*a* formed in the corner of the inside wall and the bottom thereof to provide a notch for engaging the O-ring 2 and a bush 11 having a female screw embeded in a bottom portion thereof for engaging the screw 4. A reinforcement ring 13 having an L-shaped section is secured to a back 12 at an inner portion by projection welding, spot welding, or brazing. An outside wall of the reinforcement ring 13 is adjacent to a lower portion of the inner periphery of the side wall of the case body 10 to close the opening of the recessed shoulder so that a groove 14 for engaging the O-ring 2 is defined. As hereinbefore described, the back 12 is made of hard alloy having a longitudinal elasticity modulus larger than 25,000 kg/mm$^2$.

Thus, the back 12 having a high longitudinal elasticity modulus is reinforced by the reinforcement ring 13 integrated with the back 12, so that the thickness a can be remarkably reduced and also deflection of the back can be reduced to a small amount. An experiment was conducted on a watchcase in which thickness a of the back 12 is 0.4 mm and other measurements are the same as FIG. 1. By the experiment the back 12 was deflected by 0.08–0.09 mm. As a result, the space b between the back 12 and module 7 can be reduced to 0.10 mm. Therefore, the whole thickness t of the watchcase can be reduced to 2.85 mm which is thinner than the thickness of the above mentioned conventional watchcase by 0.7 mm. Although the illustrated watchcase has a rectangular front shape, the present invention may be used in a water-resisting watchcase having a round front shape.

What is claimed is:

1. A watchcase comprising a case body having a recessed shoulder at the corner of the axially extending inside wall and the bottom thereof, a back made of hard metal having a longitudinal elasticity modulus larger than 25,000 kg/mm$^2$, means for securing said back to the bottom of said case body, a reinforcement member having an ouside wall and secured to the inside wall of said back so that a groove is defined by the outside wall of said reinforcement member and the inside wall of said recessed shoulder, and an O-ring engaged with said groove.

2. A watchcase according to claim 1 wherein said reinforcement member is a ring having an L-shaped section.

3. A watchcase according to claim 1 wherein said means comprises a female screw embeded in said case body and a screw engaged with the female screw.

* * * * *